United States Patent [19]

Marshall

[11] Patent Number: 4,993,710

[45] Date of Patent: Feb. 19, 1991

[54] SKEWED BUBBLE TUBE FOR GOLF CLUB LIE INDICATOR

[76] Inventor: Perry C. Marshall, 103 Granada Ct. North, Plant City, Fla. 33567

[21] Appl. No.: 538,299

[22] Filed: Jun. 14, 1980

[51] Int. Cl.[5] ..... A63B 69/36; A63B 57/00

[52] U.S. Cl. ..... 273/32 H; 273/186 A; 273/162 B; 273/163 R; 33/334; 33/379; 33/347; 33/508

[58] Field of Search ..... 273/32 H, 32 B, 162 B, 273/163 R, 163 A, 164, 183 D, 186 A, 186 C, 186 R, 194 A; 33/334, 379, 371, 373, 381, 382, 384, 508

[56] References Cited

U.S. PATENT DOCUMENTS

| | | | |
|---|---|---|---|
| 175,702 | 4/1876 | Haskell | 33/334 |
| 2,287,863 | 6/1942 | Buckley | 33/379 |
| 3,138,878 | 6/1964 | Mehlman | 33/379 |
| 4,527,799 | 7/1985 | Solheim | 273/183 D |
| 4,580,350 | 4/1986 | Fincher | 273/162 B |

FOREIGN PATENT DOCUMENTS

| | | | |
|---|---|---|---|
| 94115 | 1/1939 | Sweden | 33/381 |

OTHER PUBLICATIONS

"Modern Plastics", Apr. 1945, pp. 122 and 123.

*Primary Examiner*—George J. Marlo
*Attorney, Agent, or Firm*—Joseph C. Mason, Jr.; Ronald E. Smith

[57] ABSTRACT

A lie indicator for a golf clubhead that has utility as a golf practice aid. The indicator includes a straight bubble tube mounted in slightly skewed relation to a base member so that the axis of the tube and the axis of the base member are skewed at about one degree with respect to one another. The base member includes a flush mounted magnet that releasably secures the indicator to the face of the clubhead. The base member is aligned with a score line on the face of the clubhead so that when the golfer centers the bubble in the tube, an apparent one degree over compensation is provided. However, the lie angle of the clubhead is correct at the moment of ball impact because the mass of the clubhead causes it to rotate during the swing by about one degree.

11 Claims, 2 Drawing Sheets

SKEWED BUBBLE TUBE FOR GOLF CLUB LIE INDICATOR

TECHNICAL FIELD

This invention relates, generally, to practice aides having utility in practicing the game of golf. More particularly, it relates to a lie indicator that informs a golfer how to properly hold a golf club prior to swinging it.

BACKGROUND ART

In golf, the angle between the hosel or club axis and a horizontal plane is called the lie angle. Ideally, the sole of the clubhead should be perfectly parallel with the ground at the moment the face of the clubhead impacts the ball. If the heel of the clubhead is higher than the toe at the moment of impact, the ball will hook or slice, depending upon whether the golfer is left or right-handed, respectively. If the toe of the clubhead is elevated with respect to the heel at said moment, the ball will deviate from its intended path of travel in the opposite direction. Moreover, the effect of an incorrect lie angle at the moment of impact is amplified as the angle of the clubhead face increases, i.e., the effects of an improper lie angle are less for putters and increasingly important as the loft angle of the clubhead face increases.

Most golfers simply use trial and error techniques and hope to eventually learn how to hold their clubs at the proper lie angle. Others employ a device shown in U.S. Pat. No. 4,580,350 to Fincher. That device includes a linear in configuration bubble tube that is releasably secured to a clubhead face. An alignment ridge mates with a preselected groove formed in the clubhead face to hold the tube level with respect to the face, and a flat spring releasably holds the bubble tube to said face. When the bubble in the bubble tube is centered, the golfer knows that the heel and toe of the clubhead are lying in a common horizontal plane. Thus, the golfer believes that if the ball is struck while the clubhead is being held in the indicated plane, then the ball will neither hook nor slice when driven. Experience, however, has shown that the use of the Fincher device still results in hooks and slices, but the source of the problem has remained unidentified for years.

The prior art, taken as a whole, neither teaches nor suggests what bedevils the Fincher device, and thus of course contains no hint as to how the limitations of that device could be overcome.

DISCLOSURE OF INVENTION

The longstanding but heretofore unfulfilled need for a lie indicator that teaches golfers how to hold a golf club is now fulfilled by a device that includes a straight bubble tube that is skewed with respect to the score lines on a golf club face when properly mounted thereon. Thus, when the golfer centers the bubble in the tube, the toe of the clubhead is elevated with respect to the heel thereof. The device has an indicator for use by left and right-handed golfers to indicate the proper placement of the device, so that the centered bubble elevates the toe over the heel for both left and right handers. The skew is one degree from the horizontal. Thus, when the golfer begins the swing, all prior art indicators would report that the clubhead lie is incorrect, and that a bad shot will result. However, as the club is swung, the weight of the clubhead causes the shaft to bend slightly. More specifically, the toe of the clubhead has more mass than the heel, so the momentum of the toe causes the shaft to flex. The amount of angular shift between toe and heel as measured with the clubhead in repose and at the moment of ball impact has been determined to be about one degree.

It should therefore be understood that the skewing of the bubble tube when the clubhead is in repose compensates for the amount of bending of the clubhead generated by the swing itself. The golfer thus initially holds the clubhead in a plane that would produce a poor shot, but the bending moment that appears when the club is swung puts the clubhead at the ideal lie angle at the moment of impact with the result that hooks and slices are substantially eliminated for golfers who practice with the novel lie indicator that is shown and described in detail hereinafter.

The primary object of this invention is to advance the art of lie indicators by providing a pre-skewed indicator that compensates for the mass of the clubhead. These and other important objects and advantages of the invention will become apparent as this description proceeds.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which.

BEST MODES FOR CARRYING OUT THE INVENTION

Figure 1:
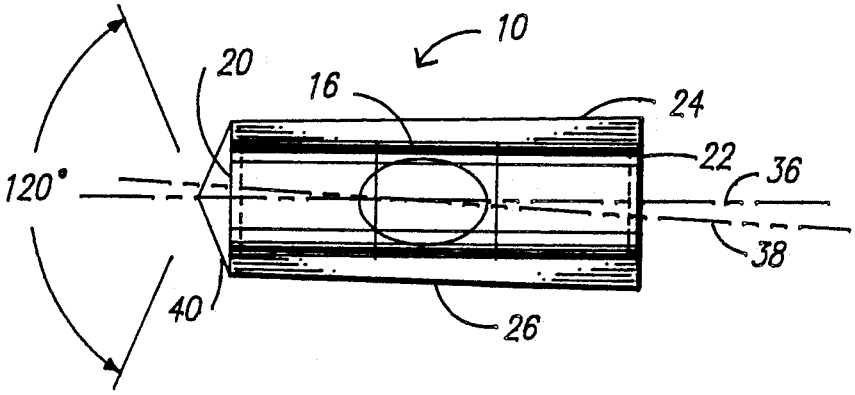
FIG. 1 is a top plan view of an illustrative embodiment of the present invention.
Figure 2:
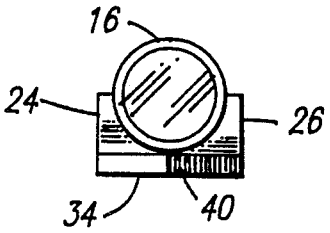
FIG. 2 is a first end elevational view thereof.
Figure 3:
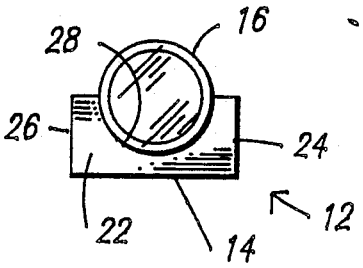
FIG. 3 is a second end elevational view thereof.
Figure 4:
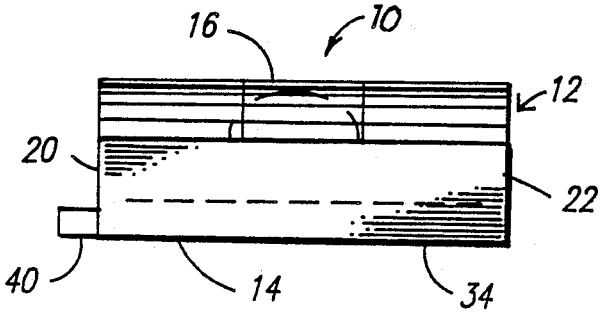
FIG. 4 is a side elevational view thereof.

Referring now to FIGS. 1–4, it will there be seen that an exemplary embodiment of the invention is denoted by the reference numeral 10 as a whole.

Lie indicator 10 includes a base 12, a permanent magnet 14, and a straight liquid-containing bubble tube 16 having a bubble 18 therein.

Base 12 is substantially hollow and includes four side walls. More particularly, it includes flat forward end wall 20, flat rearward end wall 22, flat sidewall 24, flat sidewall 26, and concave top wall 28. A cavity 30 is defined by said walls, and permanent magnet 14 of parallelepiped construction is positioned within said cavity and maintained against extraction therefrom by suitable means.

Magnet 14 has a flat wall 34 that is coplanar with the lowermost edges of the aforementioned side and end walls, i.e., wall 34 is flush with the lower edges of said walls.

Bubble tube 16 overlies and is permanently secured by suitable means to concave top wall 28 of base 12.

As shown in FIG. 1, base 12 has a longitudinal axis of symmetry 36, and tube 16 has a longitudinal axis of symmetry 38. Importantly, said axes are oblique with respect to one another. More particularly, the angle therebetween is substantially one degree.

Figure 5:
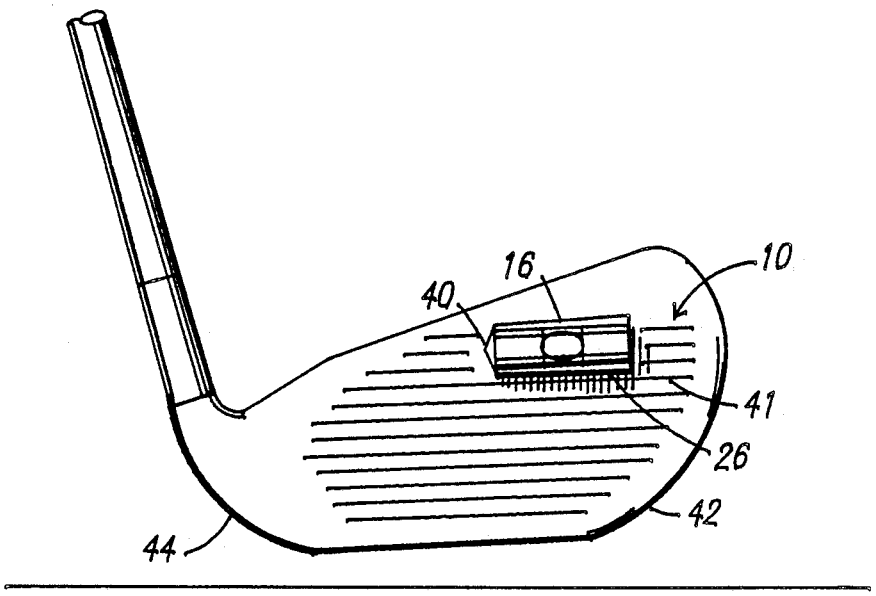
FIG. 5 depicts a centered bubble and a clubhead in repose.
Figure 6:
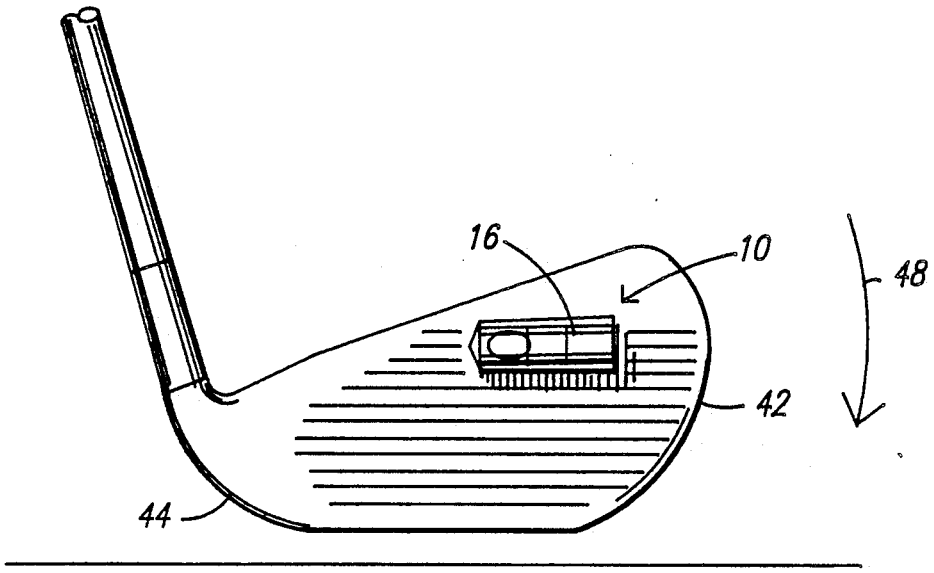
FIG. 6 depicts the clubhead of FIG. 5 at the moment of ball impact.

Arrow or pointer 40 is formed on a preselected end of base 12 as shown and serves as an attachment indicating means. The golfer, whether left-handed or right-handed, positions device 10 so that pointer 40 points toward him or her. A longitudinal lowermost edge of a sidewall 24 or 26 is positioned in registration with a score line 41 formed in the clubhead face. When the clubhead is held with its score lines parallel to the ground, bubble 18 will be off center and the golfer will be required to adjust the position of the clubhead until the bubble is centered. When the bubble is centered, the score lines of the club are skewed upwardly one degree from the horizontal, i.e., the toe 42 is elevated with respect to heel 44, as depicted in FIG. 5. As shown in FIG. 6, the massive toe 42 of the clubhead 46 displaces downwardly as indicated by the directional arrow 48 during the swing, and reaches its maximum displacement at the moment the clubhead face impacts the ball. At the moment of impact, the score lines are parallel to the ground, i.e., are in a horizontal plane.

Thus, it should be understood that the novel device teaches the golfer to hold the club in a manner that earlier devices would indicate as being incorrect. However, as the club is swung, the position of the clubhead is correct at the moment of impact when the novel device is used as a training aide, whereas the position of the clubhead face at the moment of impact is incorrect when earlier devices are used.

This invention is clearly new and useful. Moreover, it was not obvious to those of ordinary skill in this art at the time it was made, in view of the prior art, taken as a whole.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention which, as a matter of language, might be said to fall therebetween.

Now that the invention has been described,

What is claimed is:

1. A lie indicator for a golf clubhead, comprising:

a linear-in-configuration bubble tube;

said bubble tube having a first longitudinal axis of symmetry;

a linear-in-configuration base member for holding said bubble tube;

attachment means for releasably securing said base member to a clubhead face;

said base member having a second longitudinal axis of symmetry; and said first and second longitudinal axes of symmetry being disposed at a predetermined angle with respect to one another so that the bubble in said tube may be centered with the lie of the club being incorrect at the golf ball address position but becomes correct at the moment of ball impact due to the downward displacement of the toe of the head as the club head impacts the ball.

2. The lie indicator of claim 1, wherein said predetermined angle is about one degree.

3. The lie indicator of claim 2, wherein said attachment means is a permanent magnet.

4. The lie indicator of claim 3, further comprising alignment means for aligning said second longitudinal axis of symmetry of said base means in parallelism with score lines formed on said clubhead face.

5. The lie indicator of claim 4, wherein said base member includes four side walls, wherein lowermost edges of said side walls collectively define a rectangular configuration, and wherein said alignment means includes a preselected edge of said side walls, whereby said preselected edge is placed into parallelism with a preselected score line on a clubhead face to align said lie indicator.

6. The lie indicator of claim 5, further comprising an attachment indicating means for indicating a correct positioning of the lie indicator relative to said clubhead face.

7. The lie indicator of claim 6, wherein said attachment indicating means includes a pointer formed integrally with said lie indicator.

8. A lie indicator adapted to be releasably attached to the face of a golf clubhead, comprising:

a straight bubble tube that is partially liquid-filled and that has an air bubble therein;

said bubble tube having a first longitudinal axis of symmetry;

a straight base member for holding said bubble tube;

said base member having a second longitudinal axis of symmetry;

said first and second longitudinal axes of symmetry being disposed oblique to one another at about a one degree angle so that the bubble in said tube may be centered with the lie of the club being incorrect at the golf ball address position but becomes correct at the moment of ball impact due to the downward displacement of the toe of the head as the club head impacts the ball; and attachment means for releasably securing said base member to said clubhead face.

9. The lie indicator of claim 8, wherein said base member includes four side walls that collectively form a hollow cavity therebetween, wherein a permanent magnet is permanently positioned within said cavity, wherein an operative face of said permanent magnet is flat and positioned flush with lowermost edges of said side walls, said permanent magnet being said attachment means.

10. The lie indicator of claim 9, further comprising an attachment indicating means in the form of a pointer that is integrally formed with said base member.

11. The lie indicator of claim 10, further comprising alignment means for aligning said lie indicator and said clubhead face, said alignment means being a lowermost edge of a preselected side wall, said lowermost edge being disposed in parallelism with a score line formed on said clubhead face.

* * * * *